United States Patent [19]

Berglund et al.

[11] Patent Number: 4,536,043

[45] Date of Patent: Aug. 20, 1985

[54] OPERATING DEVICE IN A DISH-WASHING MACHINE

[75] Inventors: Lars G. Berglund, Alingsås; Sven-Erik B. Björklund, Älvängen; Lars H. Linde, Alingsås, all of Sweden

[73] Assignee: Aktiebolaget Electrolux, Stockholm, Sweden

[21] Appl. No.: 513,606

[22] Filed: Jul. 14, 1983

[30] Foreign Application Priority Data

Jul. 19, 1982 [SE] Sweden ..... 8204395

[51] Int. Cl.[3] ..... A47B 51/00

[52] U.S. Cl. ..... 312/222; 312/312

[58] Field of Search ..... 292/201, 216; 312/215, 312/222, 284, 312, 208, 209

[56] References Cited

U.S. PATENT DOCUMENTS

| | | | |
|---|---|---|---|
| 1,338,724 | 5/1920 | Gledhill | 292/216 |
| 3,073,637 | 1/1963 | Block | 292/216 |
| 3,190,711 | 6/1965 | Haas | 312/284 |
| 3,506,292 | 4/1970 | Hagendoorn et al. | 292/216 |

FOREIGN PATENT DOCUMENTS

| | | | |
|---|---|---|---|
| 1678085 | 7/1971 | Fed. Rep. of Germany | 292/201 |

*Primary Examiner*—Francis K. Zugel
*Assistant Examiner*—Joseph Falk
*Attorney, Agent, or Firm*—Alfred E. Miller

[57] ABSTRACT

Dish-washers of catering type are often carelessly handled. A condition for a long life of the locking device in a hood dish-washing machine with automatic opening of the hood (13) is that the hood can also be opened manually. A locking device (20) in which the curve portion (31) can be removed from the curve follower included therein both electromechanically and mechanically is according to the invention a solution to the locking problem in such machines.

4 Claims, 3 Drawing Figures

OPERATING DEVICE IN A DISH-WASHING MACHINE

The present invention relates to an operating device in a so-called one-tank, hood dish-washing machine which has a working cycle starting when the hood is put down above the dish goods and lasting a couple of minutes to end by the hood being opened automatically.

It is priorly known to provide electromechanical lock devices at the door of a dish washer so that the door is opened at the end of a programme and the dish cabinet ventilated through the door opening. The advantage of such a device is that the kitchen staff will immediately see that washing is finished and that drying of the goods starts immediately by the airing through the opening. During a proceeding washing programme, however, the dish cabinet is locked and afterloading of goods cannot take place unless the lock is broken up. Especially in catering machines the possibility of afterloading will offer a great advantage and, thus, a locking device which is rapidly opened and closed during a programme is useful.

By the invention an operating device for a dishwasher hood is presented which works independently of the programme position but keeps the function of automatic opening of the hood after the end of a programme. A locking device having this function is of combined electromechanical and mechanical type and has as its principle parts a locking curve disc and a curve follower which are operated individually, on one hand by an electromagnet and on the other hand by the movement of the hood. The special properties of the device thus obtained are defined in the characterizing part of claim 1.

Figure 1:
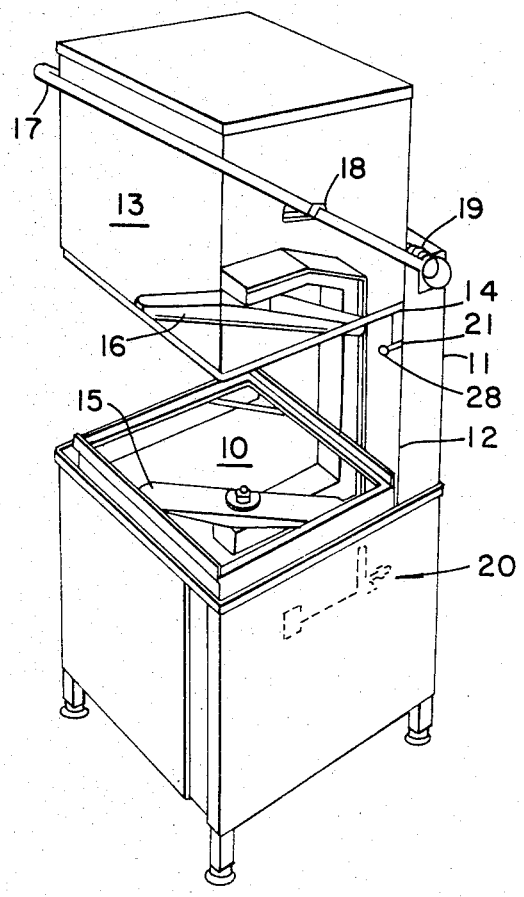

An embodiment of an operating device in a dish washer according to the invention will be described in the following reference to the accompanying drawings, showing in:

FIG. 1 a perspective view of a dish washer

Figure 2:
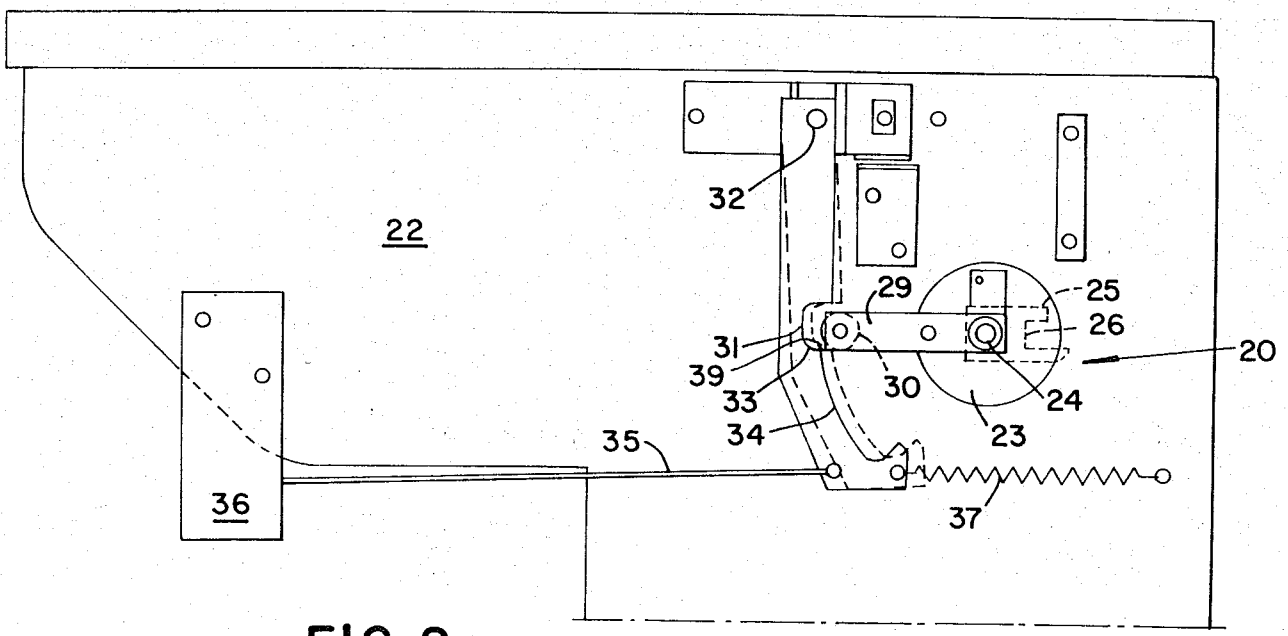

FIG. 2 a vertical projection of a locking device

Figure 3:
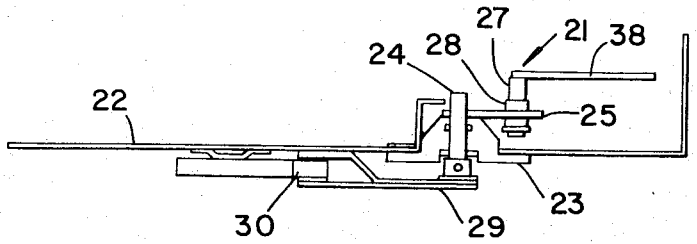

FIG. 3 a horizontal projection of the locking device.

An orientation of the position of the operating device in a hood dish-washing machine is given in FIG. 1. A tank and equipment portion 10 has an upright post 11 in which guide rods 12 are provided for a hood 13 having guide blocks 14 fitting these guides. The hood will then be vertically displaceable between a lower, operating position and an upper, loading and unloading position. In the lower position the dish goods are enclosed by the hood and during washing positioned on a rack on the portion 10. Lower and upper spray systems 15, 16, respectively, are provided for spraying the goods. Lowering of the hood is carried out manually by means of a handle frame 17 which is pivoted in the top of the post and has pivots 18 at the side surfaces of the hood. The ends of the frame are connected to helical springs 19 in the top end of the post, and by swinging the frame downwards, these springs are tensioned and act to move the hood upwards to the upper (shown) end position. In order to keep the hood in the lower (operating) position there are a locking device 20 in the tank portion 10 and an actuating member 21 in the hood.

The locking device is shown in detail in FIGS. 2 and 3. In a side plate 22 of the tank portion there is a bearing 23 of a shaft 24, and to the inner end thereof an arm 25 with a bifurcated end 26 is secured. The actuating member 21 in the form of a roller 28 on a shaft 27 carried by a console 38 inside the hood fits in the bifurcated end (FIG. 3) and swings the arm 25 between several positions in dependence on the movement of the hood. The outer end of the shaft is provided with another arm 29 with a roller 30 journalled at its outer end. This roller acts against a curved part 31 which is pivoted on a shaft 32 and having a recess 33 and a sloping portion 34. The recess and the sloping portion are interconnected by a sharp edge 39. The lower end of the curved part is connected by a rod 35 to the armature of an electromagnet 36, which when actuated swings the curve portion around the shaft 32 to the position shown in continuous lines. The roller co-operating with the steps of the curve is free and the shaft 24 is freely swingable. The hood 13 can be moved freely in the vertical direction. As said before, the springs will then move the hood into the position shown in FIG. 1.

When the current to the magnet 36 is broken the curve portion is put, by a spring 37 tensioned in opposite direction to the action of the magnet, into the position shown in dotted lines and gets in contact with the roller 30. When the hood is in the open position the roller is on the sloping portion 34. During the movement downwards of the hood the roller 28 hits the bifurcated end so that the arms 25, 29 are turned clockwise (FIG. 2). The roller 30 snaps into the recess 33 when the hood reaches the lower end position, the curved part 31 and the spring 37 locking the hood in this position, i.e. solely the force of the springs 19 cannot lift the hood.

However, in dependence on the shape of the recess 33, the curved part can be forced to swing to the position shown in continuous lines, if the lifting force of the springs is complemented by a manual force, i.e. if someone lifts the handle 17. The roll will then roll over to the portion 34, while the hood moves to its upper end position to be kept there by the springs 19.

The locking device gives a combination of two ways of opening, first a manual way which has now been described, and then an automatic way by supplying current to the magnet 36. This current comes from a control device or a time switch which usually are included in a machine of the type concerned. When the operating period is over a pulse is supplied to the magnet, which pulls the curve portion to the position shown by continuous lines, whereby the locking device opens and the hood is lifted by the springs 19.

The embodiment now described is an example of a realization of the invention. Variations of the embodiment can be carried out without departing from the inventive idea, e.g. the arm 29 supporting the roller can instead of the curved part be resilient and transferred to the adjacent sloping portion to the curve when the hood is opened manually. It is also possible to have a curved follower which is stationary and a curve part which is movable with the hood.

We claim:

1. A locking device for a dish-washing machine having a vertically movable hood adapted to take an open position and a closed position, respectively, said hood being locked in its closed position during a cleaning operation, comprising: a locking means, an actuating member provided on said hood and co-acting with said locking means, and electro-magnetic means operating to inactivate said locking means, wherein said locking means includes a curved part and a curve follower, an elastic member being provided for biasing said curved part into engagement with said curve follower, said curved part having a recess and a sloped portion, and a sharp edge interconnecting said recess and sloped portion, said actuating member during movement of the hood to its closed portion operating to bring said curve follower into said recess of the curved part, while said actuating member during movement of the hood to its open position operates to force said curve follower against the action of the said elastic means out of the recess through the sharp edge and to the sloped portion of the curved part.

2. A locking device as set forth in claim 1 wherein said elastic member exerts a resetting force on the electromechanically controlled movement of said locking means.

3. A locking device as claimed in claim 1 further comprising a rotatably supported shaft and a first lever fixed to said rotatably supported shaft and having a fork-shaped end, said actuating member being in the shape of a cylindrical pin, said pin engaging with said fork-shaped end of said first lever, and a second lever supporting said curve follower and being fixed to said shaft.

4. A locking device as claimed in claim 3 wherein said actuating member during the movement of said hood to said closed position rotates said shaft and swings the curve follower along said sloped portion and into said recess in the curved part, and during movement of said hood out of the closed position swings the curve follower out of said recess.

* * * * *